US010804641B2

(12) United States Patent
Zhou et al.

(10) Patent No.: US 10,804,641 B2
(45) Date of Patent: Oct. 13, 2020

(54) ELECTRICAL CONNECTOR HAVING A METALLIC INNER SHELL WITH REAR ENGAGING FINGER SITUATED WITHIN AN INSULATIVE OUTER COVER

(71) Applicants: FOXCONN (KUNSHAN) COMPUTER CONNECTOR CO., LTD., Kunshan (CN); FOXCONN INTERCONNECT TECHNOLOGY LIMITED, Grand Cayman (KY)

(72) Inventors: Shao-Cong Zhou, Huaian (CN); Jun Zhao, Huaian (CN); Cai-Yun Zhang, Huaian (CN)

(73) Assignees: FOXCONN (KUNSHAN) COMPUTER CONNECTOR CO., LTD., Kunshan (CN); FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

(21) Appl. No.: 16/381,044

(22) Filed: Apr. 11, 2019

(65) Prior Publication Data

US 2019/0319393 A1 Oct. 17, 2019

(30) Foreign Application Priority Data

Apr. 11, 2018 (CN) ..... 2018 1 0321404
Apr. 11, 2018 (CN) ..... 2018 1 0322727

(51) Int. Cl.

| | |
|---|---|
| ***H01R 9/03*** | (2006.01) |
| ***H01R 13/504*** | (2006.01) |
| ***H01R 13/52*** | (2006.01) |
| ***H01R 13/405*** | (2006.01) |

(52) U.S. Cl.
CPC ..... *H01R 13/5045* (2013.01); *H01R 13/405* (2013.01); *H01R 13/5202* (2013.01)

(58) Field of Classification Search
CPC ..... H01R 13/5045; H01R 13/405; H01R 13/5202; H01R 13/6582; H01R 13/504
USPC ..... 439/589, 607.58
See application file for complete search history.

(56) References Cited

U.S. PATENT DOCUMENTS

| | | | | |
|---|---|---|---|---|
| 9,385,499 | B2 * | 7/2016 | Guo | H01R 24/60 |
| 2013/0183844 | A1 | 7/2013 | Wang | |
| 2015/0295361 | A1 * | 10/2015 | Miyoshi | H01R 13/502 439/607.58 |

FOREIGN PATENT DOCUMENTS

| | | | |
|---|---|---|---|
| CN | 206225655 | U | 6/2017 |
| CN | 206727341 | U | 12/2017 |

* cited by examiner

*Primary Examiner* — Abdullah A Riyami
*Assistant Examiner* — Nelson R. Burgos-Guntin
(74) *Attorney, Agent, or Firm* — Wei Te Chung; Ming Chieh Chang

(57) ABSTRACT

An electrical connector includes: an insulative outer cover and a metallic inner shell insert molded with the insulative outer cover, the inner shell having a top wall, a bottom wall, and a pair of side walls; and a terminal module including an insulative housing and an upper and lower rows of contacts arranged in the housing, the insulative housing having a base received by the inner shell and a frontal tongue exposing the upper and lower rows of contacts respectively to two opposite surfaces thereof; wherein the inner shell has a front stop and a rear finger at the top wall respectively engaging a front and rear portions of the base, and the rear finger is situated in a rear chamber of the outer cover.

20 Claims, 18 Drawing Sheets

ELECTRICAL CONNECTOR HAVING A METALLIC INNER SHELL WITH REAR ENGAGING FINGER SITUATED WITHIN AN INSULATIVE OUTER COVER

BACKGROUND OF THE INVENTION

1. Field of the Invention

The present invention relates to an electrical connector including an insulative outer cover and a metallic inner shell insert molded with the insulative outer cover, and a terminal module including an insulative housing and an upper and lower rows of contacts arranged in the housing, wherein the inner shell has a front stop and a rear finger respectively engaging a front and rear portions of the housing.

2. Description of Related Arts

China Patent No. 206727341 discloses an electrical connector, comprising: an insulative outer cover and a metallic inner shell insert molded with the insulative outer cover; and a terminal module including an insulative housing and an upper and lower rows of contacts arranged in the housing, the insulative housing having a base received by the inner shell and a frontal tongue exposing the upper and lower rows of contacts respectively to two opposite surfaces thereof, wherein the inner shell has a plurality of stops engaging a front portion of the base and a plurality of fingers engaging a rear portion of the base which is far away from the outer cover.

SUMMARY OF THE INVENTION

An electrical connector comprises: an insulative outer cover and a metallic inner shell insert molded with the insulative outer cover, the inner shell having a top wall, a bottom wall, and a pair of side walls; and a terminal module including an insulative housing and an upper and lower rows of contacts arranged in the housing, the insulative housing having a base received by the inner shell and a frontal tongue exposing the upper and lower rows of contacts respectively to two opposite surfaces thereof; wherein the inner shell has a front stop and a rear finger at the top wall respectively engaging a front and rear portions of the base, and the rear finger is situated in a rear chamber of the outer cover.

DETAILED DESCRIPTION OF THE PREFERRED EMBODIMENTS

Figure 1:
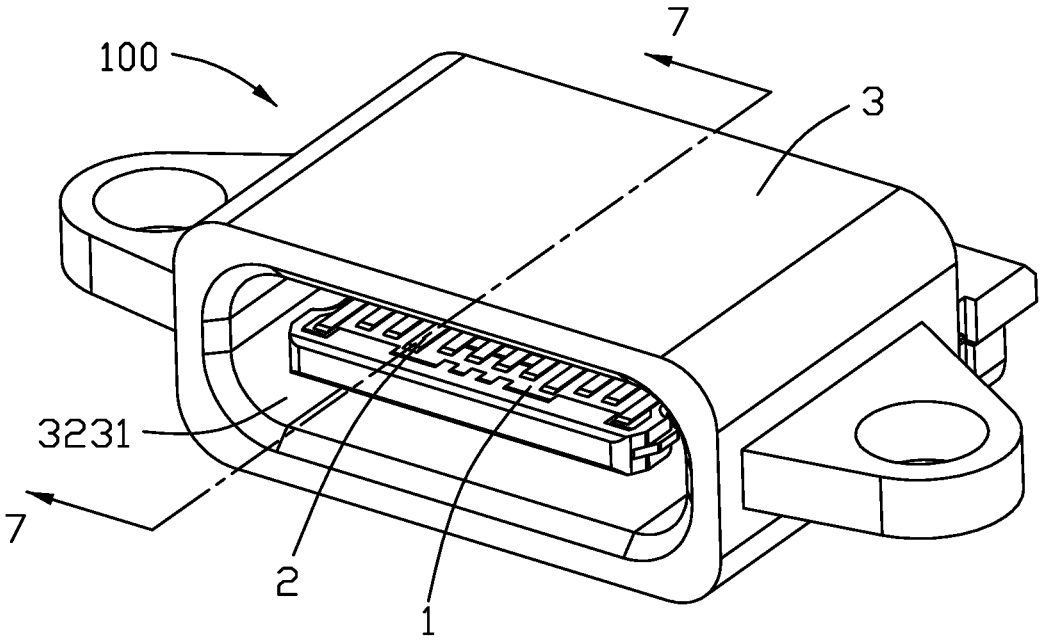
FIG. 1 is a front perspective view of an electrical connector in accordance with a first embodiment of the present invention.
Figure 2:
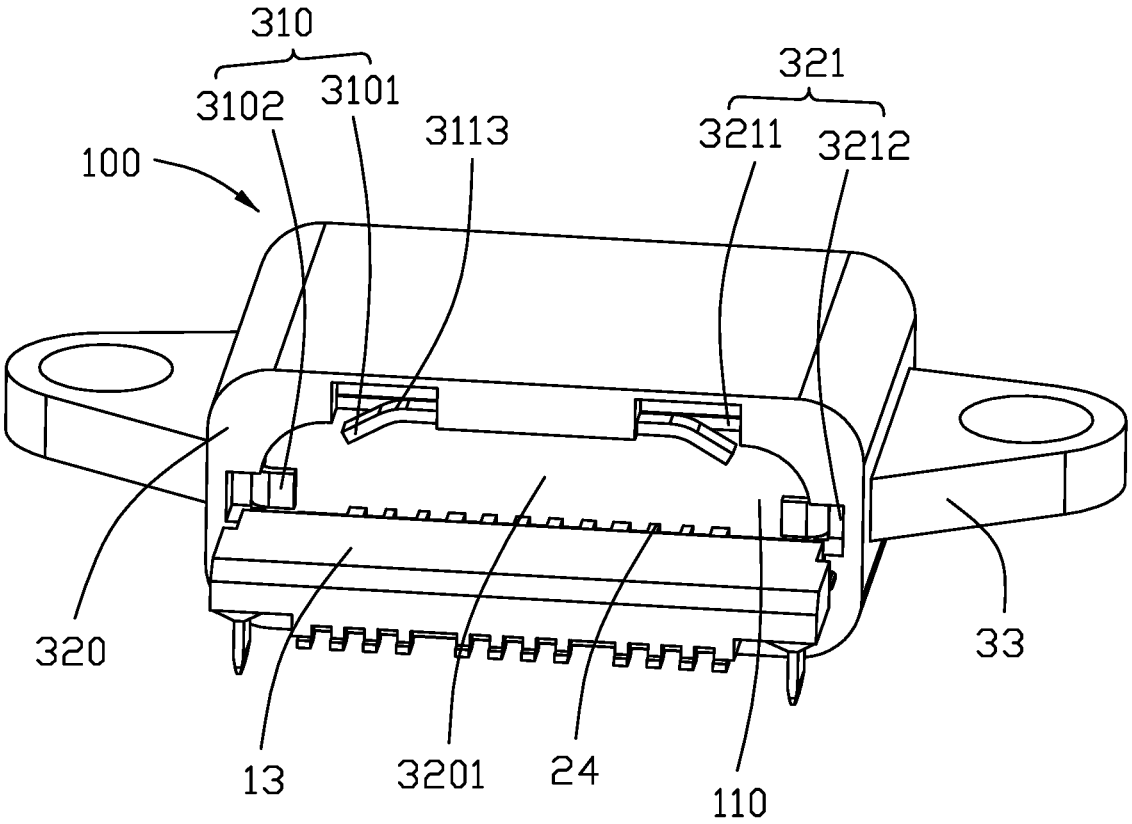
FIG. 2 is a rear perspective view of the electrical connector.
Figure 3:
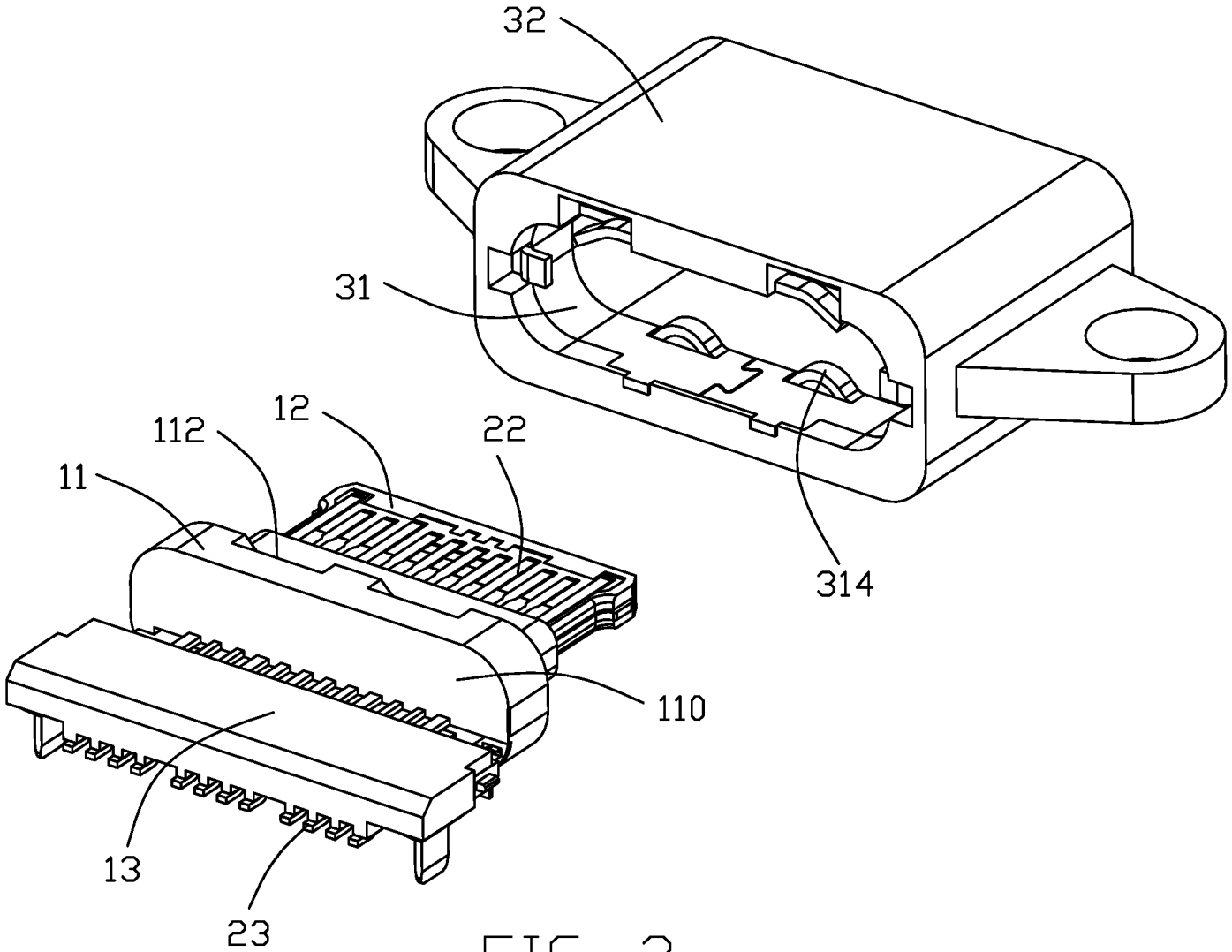
FIG. 3 is an exploded view of FIG. 2.
Figure 4:
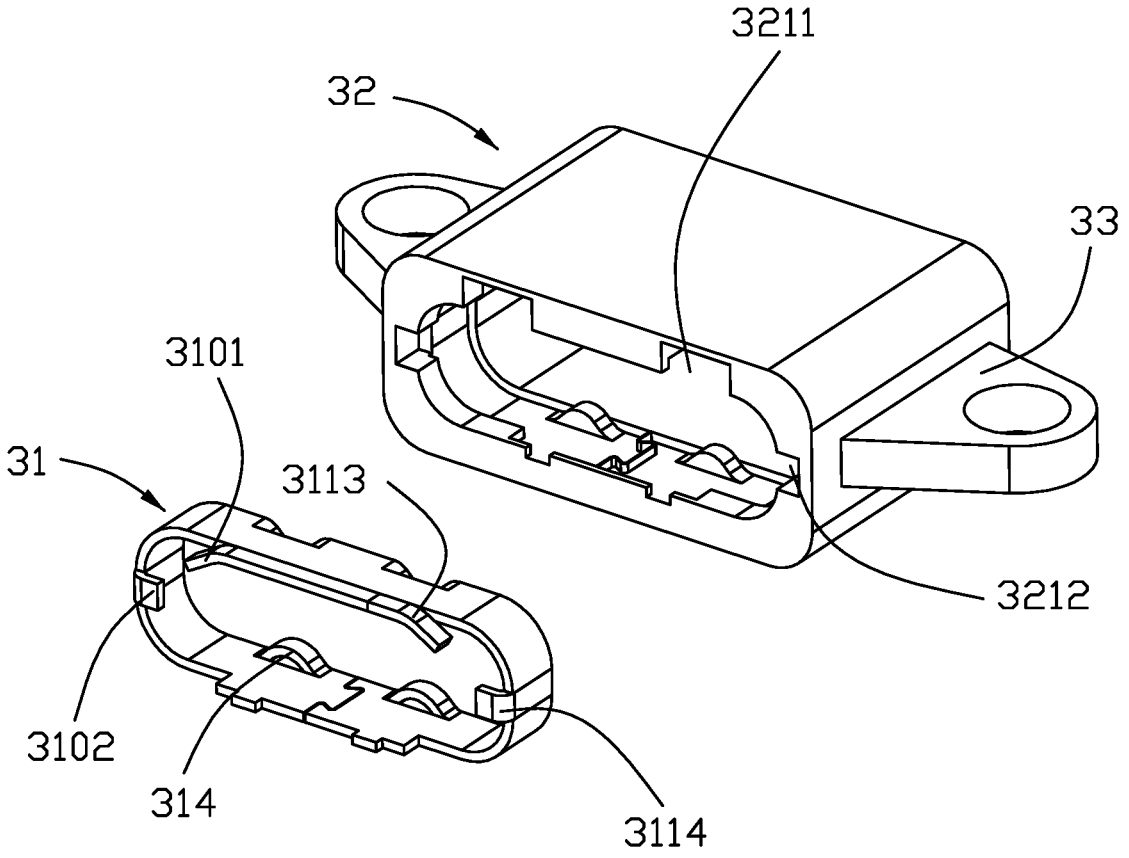
FIG. 4 is an exploded view of FIG. 3, omitting a terminal module of the electrical connector.
Figure 5:
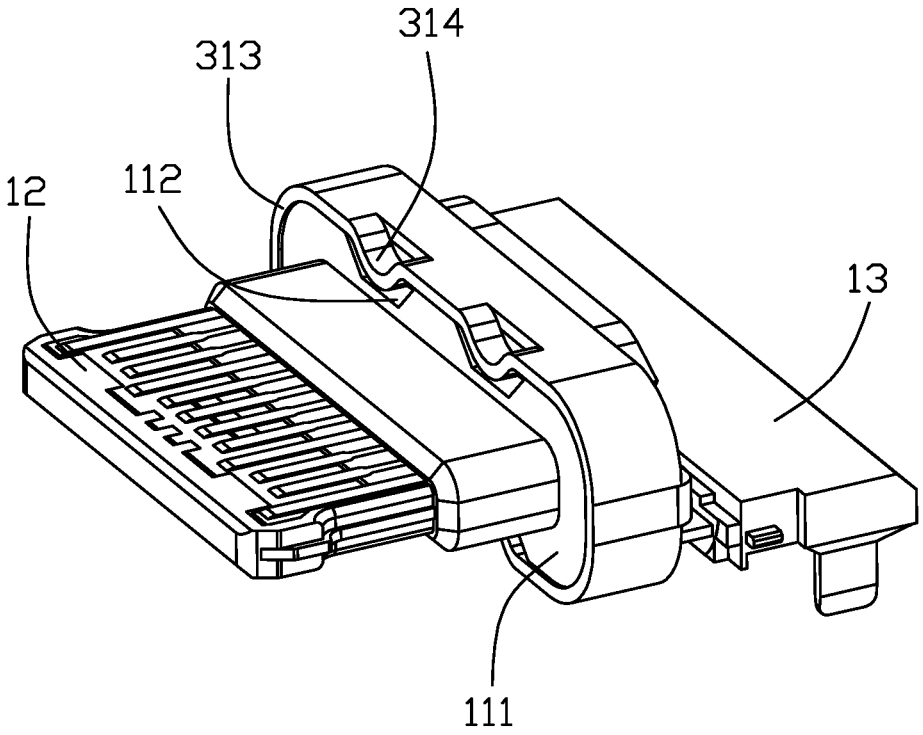
FIG. 5 is a front perspective view of the terminal module and an inner shell of the electrical connector.
Figure 6:
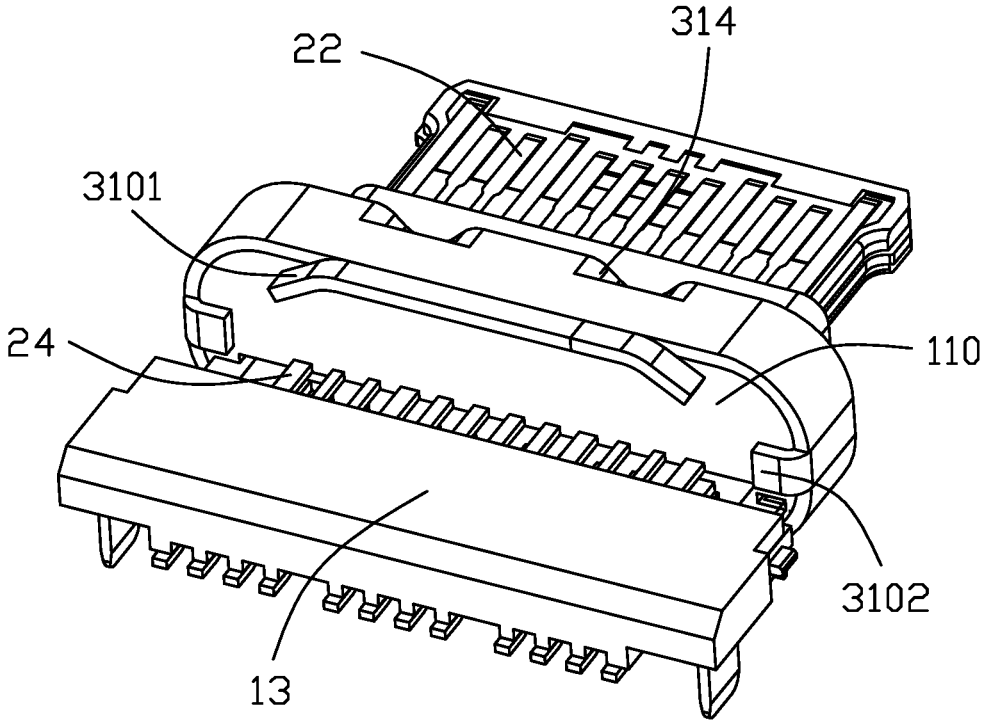
FIG. 6 is a view similar to FIG. 5 but from a rear perspective.

Referring to FIGS. 1-8, an electrical connector 100 of a first embodiment comprises an insulative housing 1 and a plurality of contacts 2 arranged in the housing 1 forming a terminal module, and an insulative tubular outer cover 32 and a metallic tubular inner shell 31, integrated and generally designated as 3, enclosing the terminal module. The electrical connector 100 may further include a rear sealing element 4.

Figure 7:
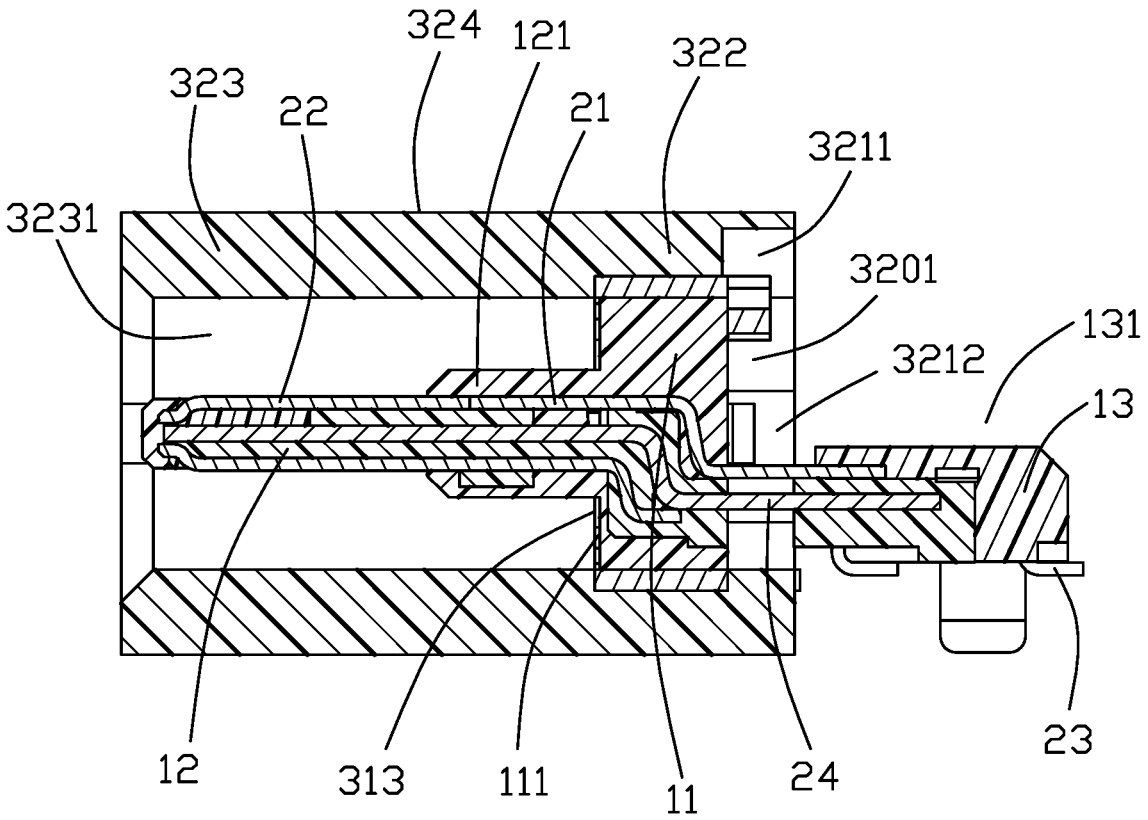
FIG. 7 is a cross-sectional view of the electrical connector taken along line 7-7 in FIG. 1.
Figure 8:
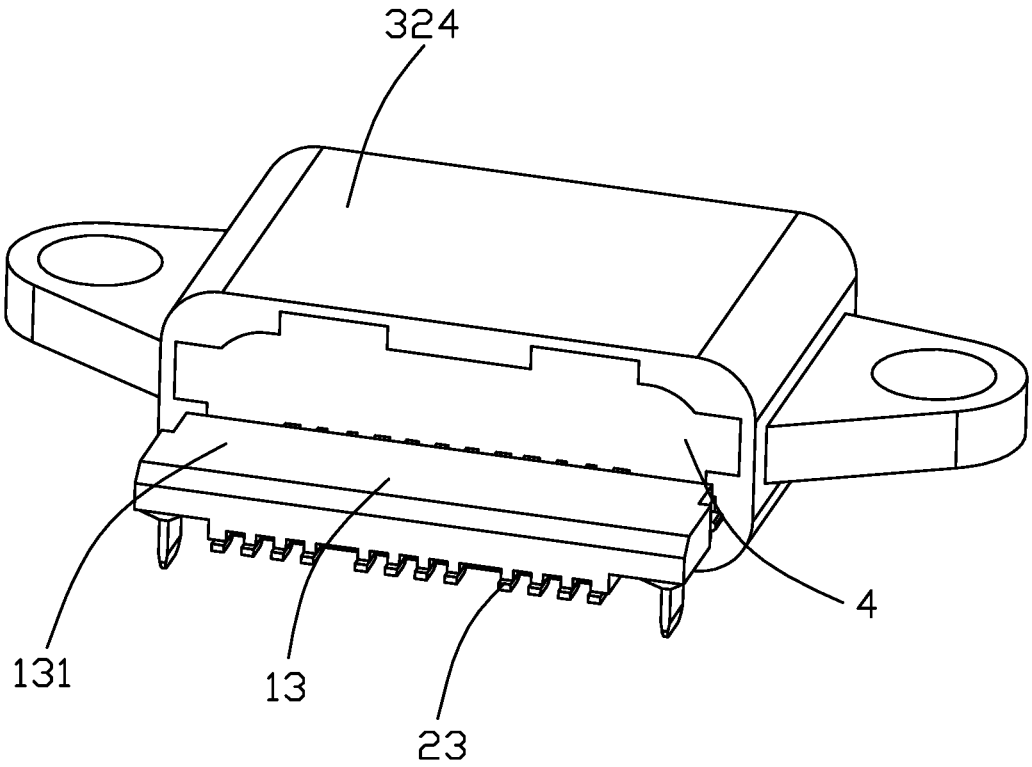
FIG. 8 is a view similar to FIG. 2 but adding a sealing member.
Figure 9:
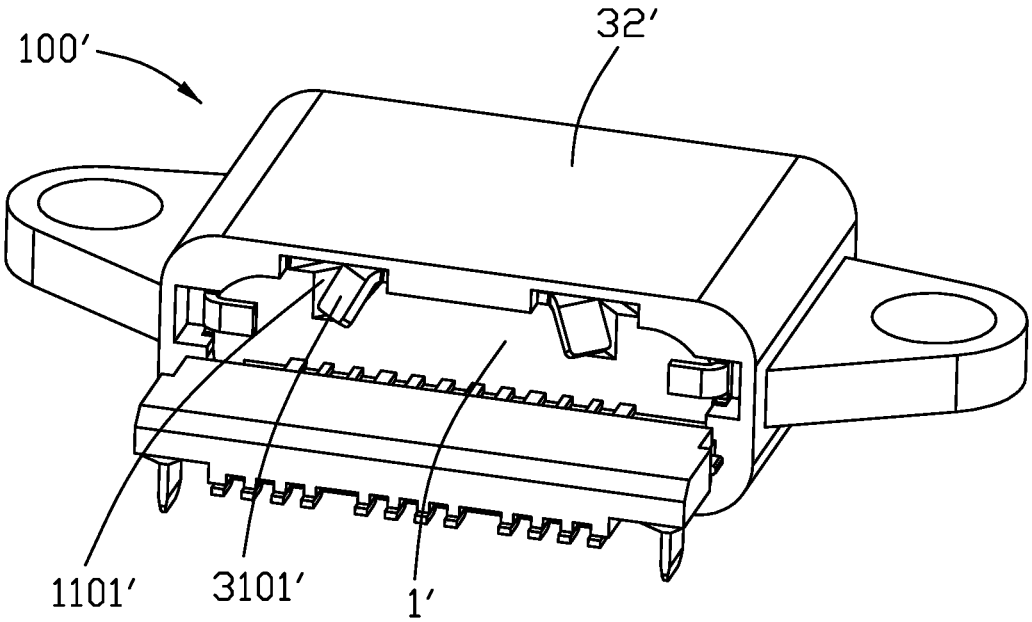
FIG. 9 is a front perspective view of an electrical connector in accordance with a second embodiment of the present invention.
Figure 10:
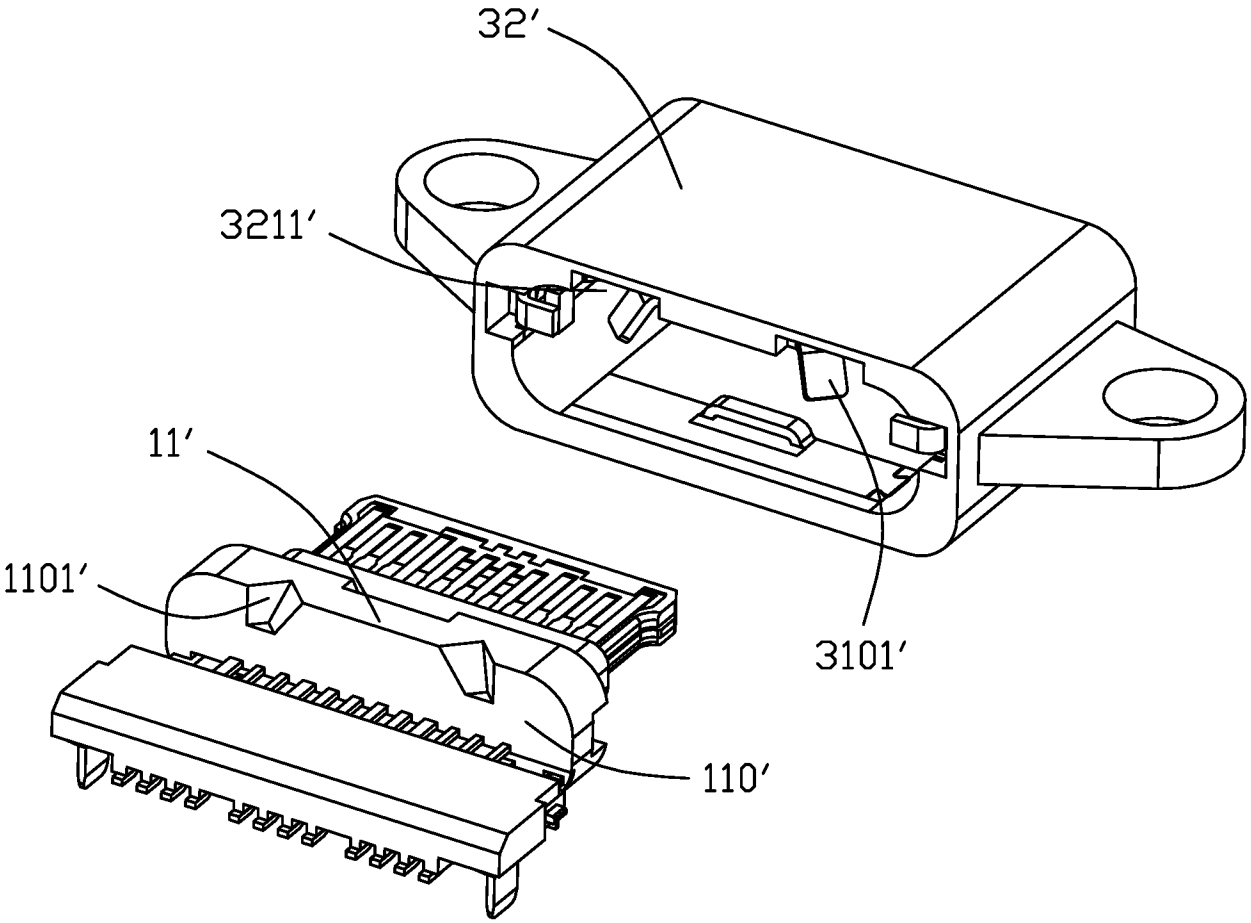
FIG. 10 is a rear exploded view of the electrical connector in FIG. 9.
Figure 11:
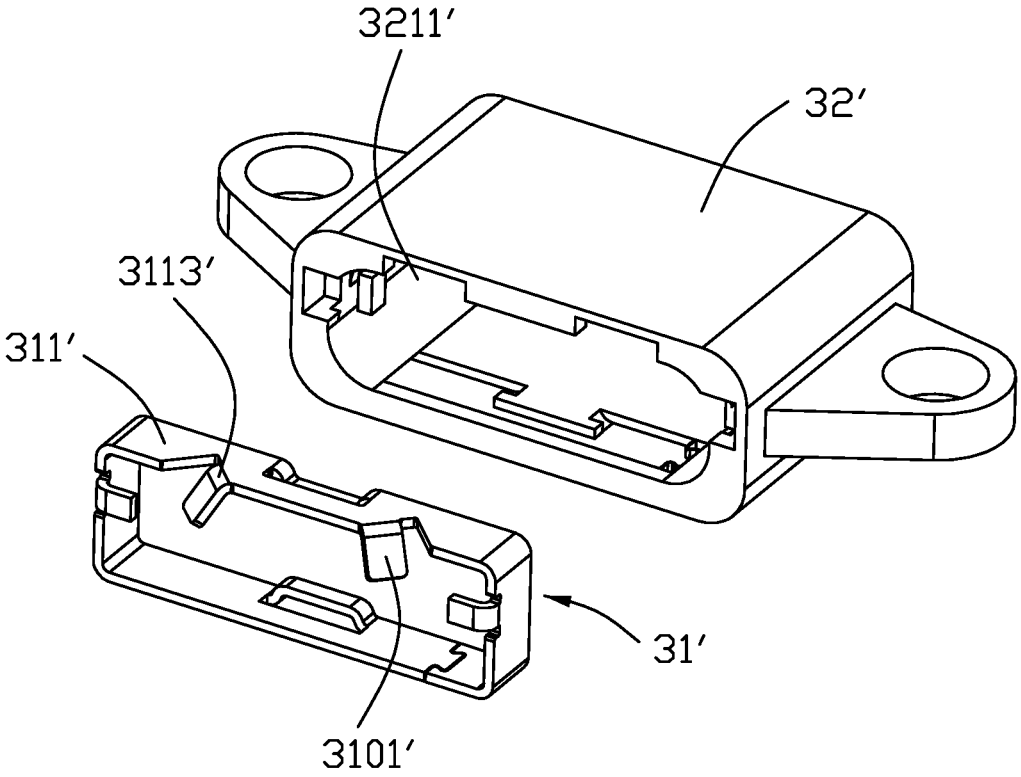
FIG. 11 is an exploded view of FIG. 10, omitting a terminal module of the electrical connector in FIG. 9.
Figure 12:
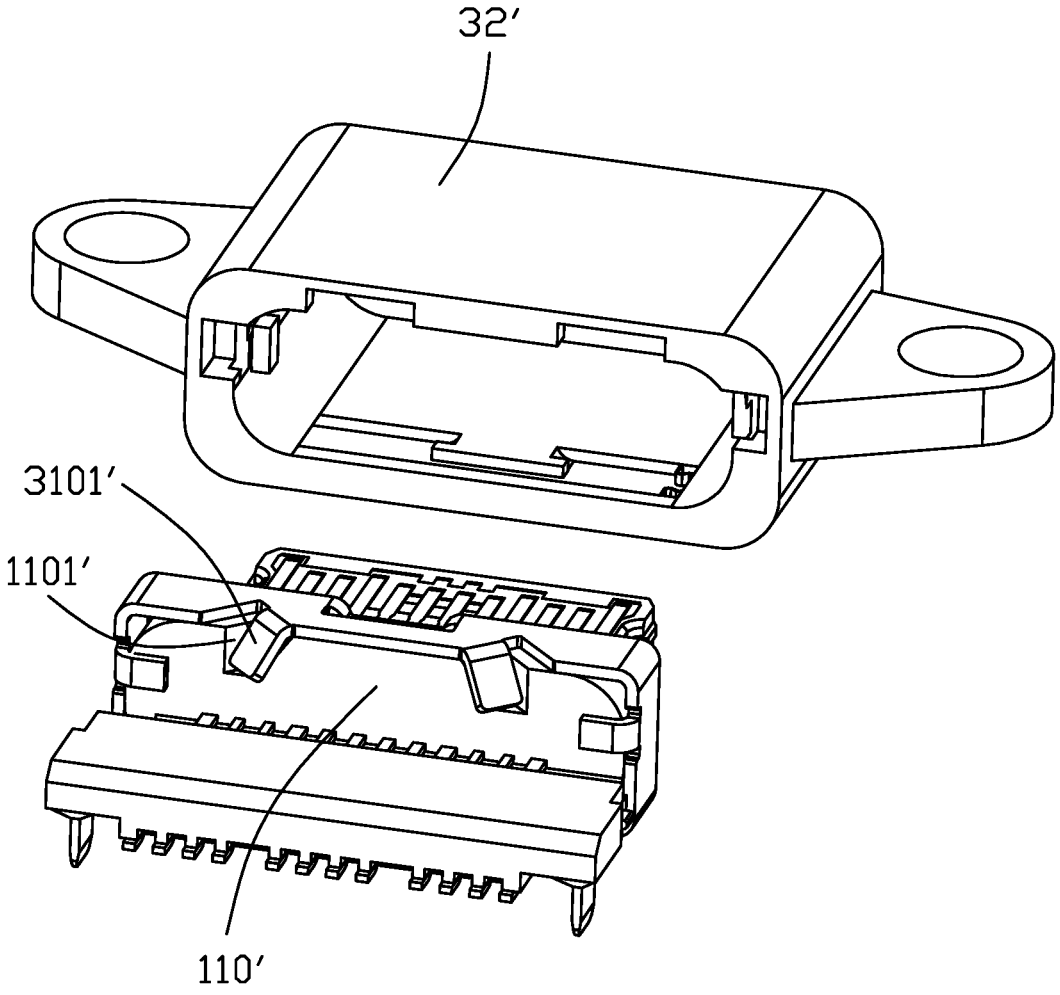
FIG. 12 is a view similar to FIG. 10 but showing an inner shell of the electrical connector in FIG. 9 positioned on the terminal module of the electrical connector in FIG. 9.
Figure 13:
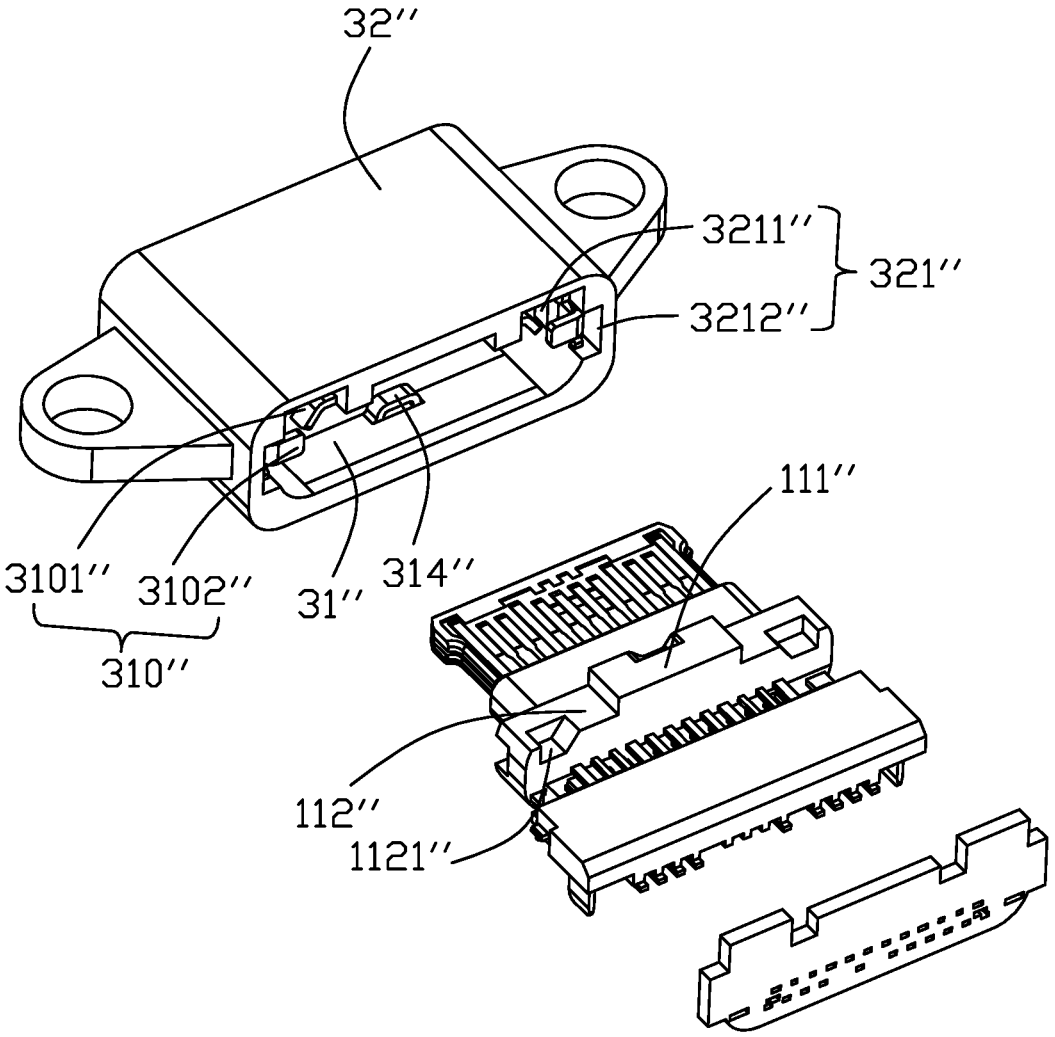
FIG. 13 is a rear exploded view of an electrical connector in accordance with a third embodiment of the present invention.
Figure 14:
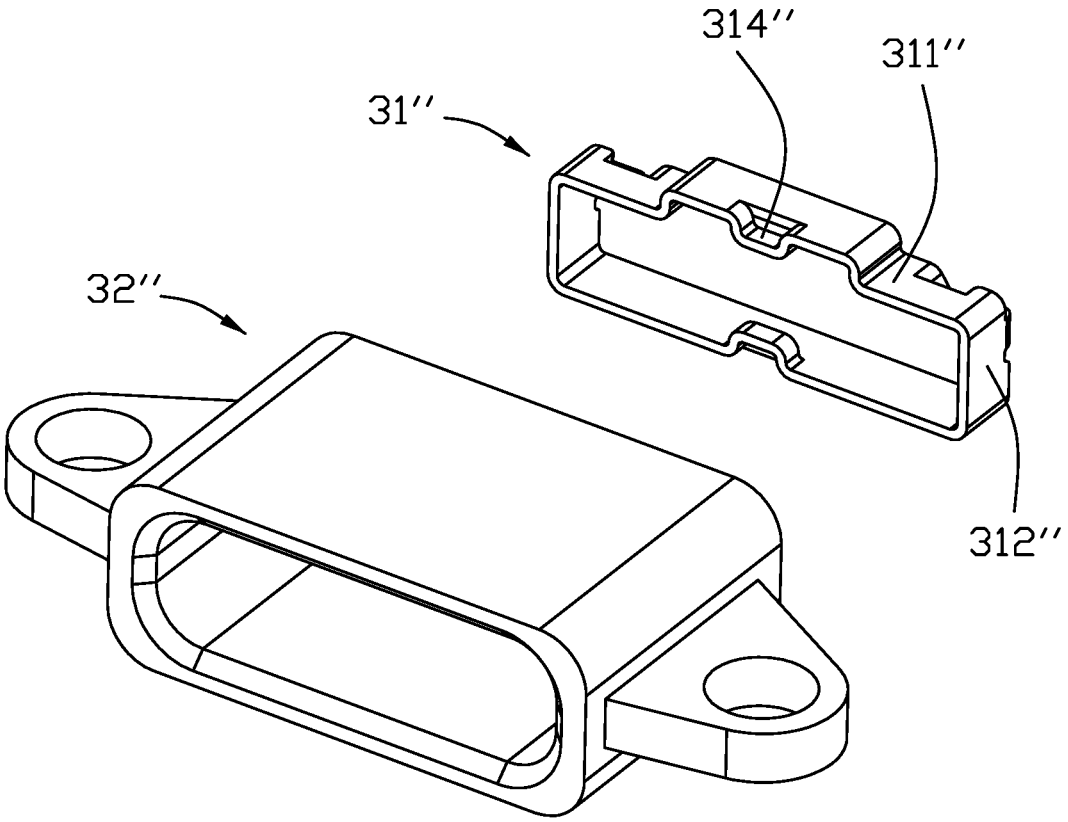
FIG. 14 is a front exploded view showing only an outer cover and an inner shell of electrical connector in FIG. 13.
Figure 15:
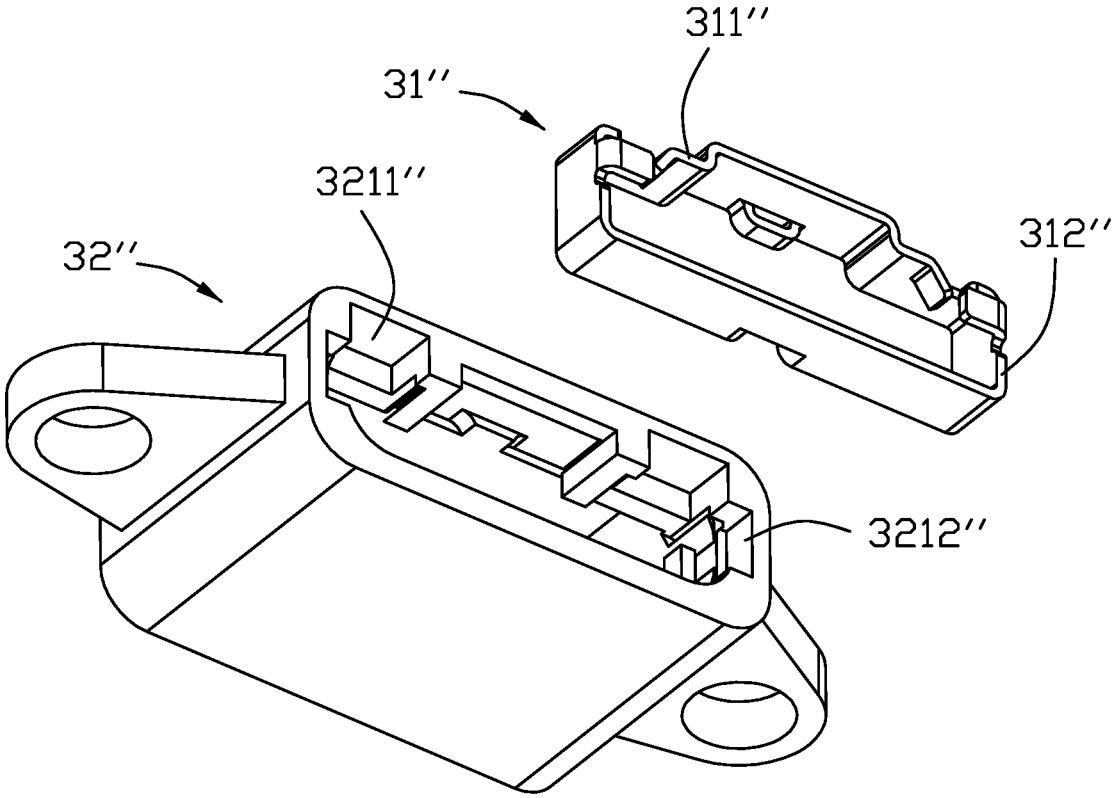
FIG. 15 is a view similar to FIG. 14 but from a rear perspective.
Figure 16:
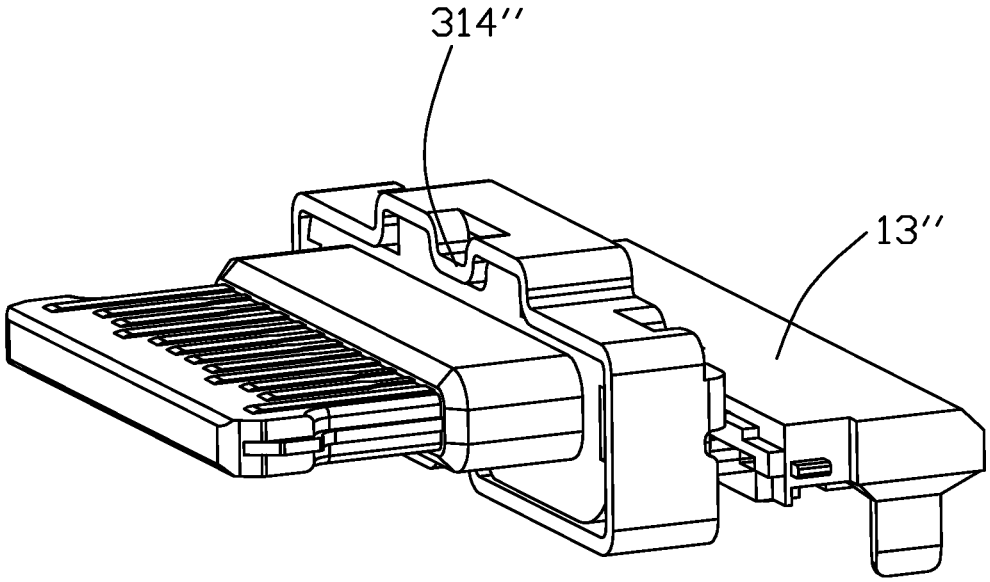
FIG. 16 is a front perspective view of a terminal module and an inner shell of the electrical connector in FIG. 13.
Figure 17:
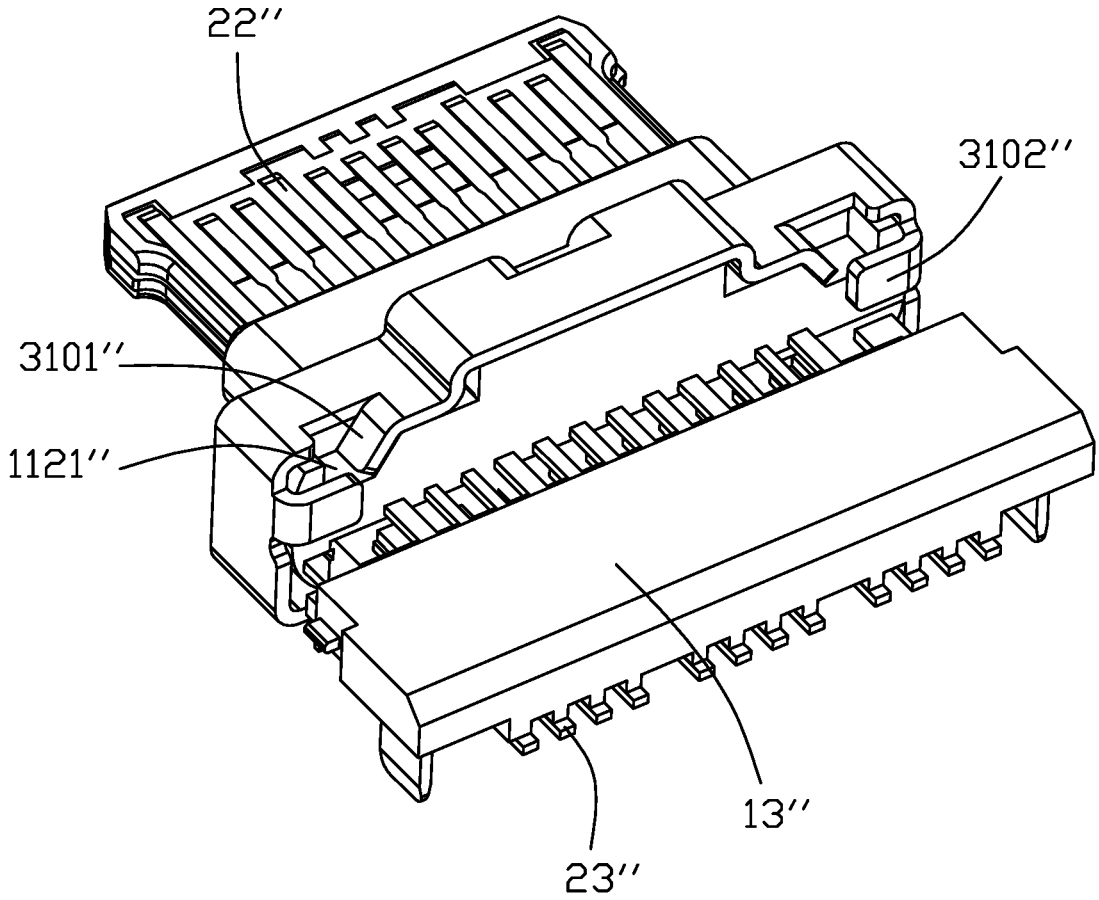
FIG. 17 is a view similar to FIG. 16 but from a rear perspective.
Figure 18:
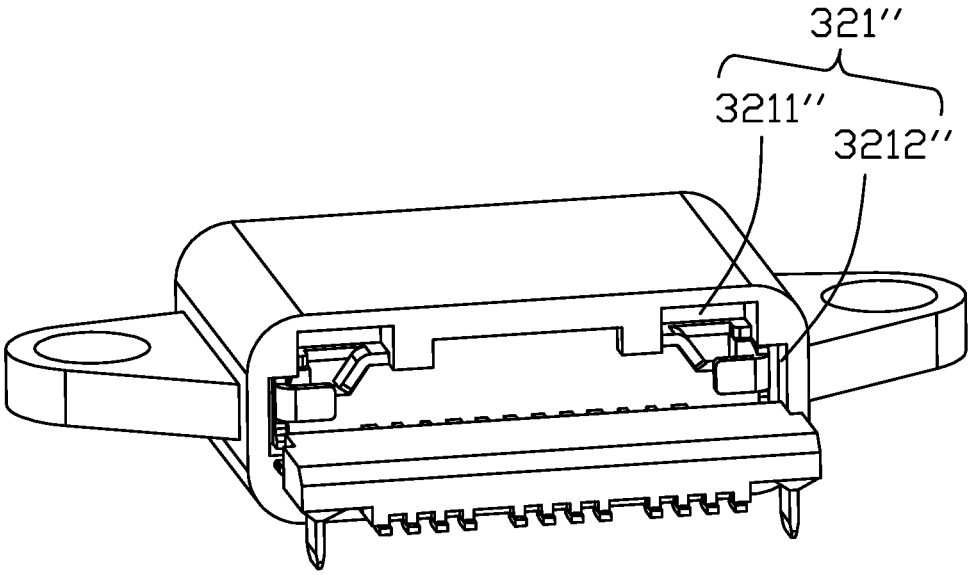
FIG. 18 is an assembled view of the electrical connector in FIG. 13 omitting a sealing element thereof.

The insulative housing 1 includes a rear base 11 and a front tongue 12. The front tongue 12 includes a thickened step section 121 around a rear end as shown in FIG. 7. Each contact 2 includes a securing portion 21, a front contacting portion 22, and a rear soldering portion 23. The insulative outer cover 32 has a pair of ears 33. After the inner shell 31 is insert molded with the outer cover 32, the terminal module is mounted along a back-to-front direction into, and therefore received by, the inner shell 31.

The outer cover 32 has a rear chamber 3201 immediately behind a rear end 110 of the base 11 for accommodating the sealing element 4. The inner shell 31 has plural fingers 310, namely, a pair of first fingers 3101 and a pair of second fingers 3102, for restricting a rearward movement of the base 11. When the sealing element 4 is present, the fingers 310 are embedded thereby. Each finger 3101 or 3102 is spaced from the outer cover 32 by a clearance/recess 3211 or 3212 in order for tools to operate the fingers during manufacturing. Specifically, the inner shell 31 has a top wall 311 with two pieces 3113 to be operated by a tool to form the pair of first fingers 3101 and a pair of side walls 312 each with a piece 3114 to be operated by another tool to form the pair of second fingers 3102.

The inner shell 31 is short in length so as not to extend over the tongue 12. The inner shell 31 generally surrounds the base 11 and therefore the tongue 12 is positioned substantially forwardly of a front end face 313 of the inner shell 31. The outer cover 32 has a rear part 322 corresponding to the inner shell 31 and a front part 323 substantially positioned forwardly of the front end face 313 of the inner shell 31. The front end face 313 of the inner shell 31 may be positioned slightly forwardly of a front end face 111 of the base 11 for protecting the base 11 from being damaged by a mating connector. The inner shell 31 has one or more stops 314 and the base 11 has one or more corresponding grooves 112. The stops 314 not only prevent the forwardly movement of the base 11 but also prevent the excessive rearward insertion of the mating connector along the front-to-back direction for protecting the base 11. In this embodiment, the front part 323 forms a mating cavity 3231, in which the tongue 12 extends, for receiving the mating connector.

The insulative housing 1 further has a rear extension 13 below the fingers 310 and a mounting space 131 is formed above the rear extension 13 behind a top wall 324 of the outer cover 32 for accommodating an external element. The extension 13 is separate from the base 11 with the contacts 2 exposed therebetween and sealed by the sealing element 4.

Referring to FIGS. 9-12, an electrical connector 100' of a second embodiment is different from the connector 100 in that a pair of first springs 3101' thereof are slanted. Unless noted, the other components and/or parts are essentially same as in the first embodiment so that same reference numerals plus an apostrophe are used while detailed descriptions thereof are omitted for simplicity and clarity. Specifically, the inner shell 31' has a top wall 311' with two pieces 3113' to be operated by a tool to form the pair of first fingers 3101'. The rear end 110' of the base 11' has a slanted groove 1101' corresponding to the slanted spring 3101'. The slanted design increases an area of engagement as well as assists in preventing a lateral movement of the base 11' with respect to the inner shell 31'.

FIGS. 13-18 show an electrical connector of a third embodiment which includes a base 11" having a higher portion 111" and two adjacent lower portions 112" and an outer cover 32" having corresponding portions 43 and 44. Each finger 3101" is spaced from the outer cover 32" by a clearance 3211". By thickening the portions 44 of the outer cover 32", the size of the clearance 3211" is made larger which facilitates tooling operation therein. The lower portion 112" further has a recess 1121" for accommodating an end of the finger 3101". Similar design of thickening may be applied to the clearance 3212" as well. Notably, in all three embodiments, the metallic inner shell 31 is shortened not to significantly communicate with the mating cavity 3231 for avoiding the undesired antenna effect. As shown in FIG. 7 the inner cover 31 except the pieces 3113, 3114 and the stop 314, is essentially embedded within the outer cover 32 along the front-to-back direction and outwardly with the corresponding outer face intimately confronting the outer cover 32 while the corresponding inner face intimately confronts the base 11 of the insulative housing 1. The rear sealing element 4 further covers the two pieces 3113 so the inner shell 31 is essentially hidden from the exterior. Generally speaking, the metallic inner shell 31 is secured to the insulative outer cover 32 via an insert-molding process, and the housing 1 of the terminal module is assembled into and retained, via bending/deforming the fingers 3101, within the metallic inner shell 31 not only circumferentially but also along the front-to-back direction, thus easing the assembling way and assuring the reliable securement among these three main elements. In the embodiments, the mating cavity 3231 is located in front of the base 11, and the front edge of the inner shell 11 essentially slightly project beyond the base 11 while not beyond a front edge of the thickened step section 121. In the embodiment, the first finger 3101 abuts forwardly against the base 11 via the corresponding side edge while the second finger 3102 abuts forwardly against the base 11 in a planar manner. In the embodiments, the stop 314 is formed on the inner shell 31. Alternately, the stop may be formed on the outer cover instead.

What is claimed is:

1. An electrical connector comprising:

an insulative outer cover and a metallic inner shell insert molded with the insulative outer cover; and a terminal module separately mounted to the insert molded inner shell and outer cover and including an insulative housing and an upper and lower rows of contacts arranged in the housing, the insulative housing having a base and a frontal tongue exposing the upper and lower rows of contacts respectively to two opposite surfaces thereof; wherein the inner shell has a front stop and a rear finger respectively engaging a front and rear portions of the base, and the rear finger is situated in a rear chamber of the outer cover.

2. The electrical connector as claimed in claim 1, wherein a clearance is provided between the rear finger and the outer cover, and the rear finger is bent away from the clearance.

3. The electrical connector as claimed in claim 1, wherein the rear finger is slanted.

4. The electrical connector as claimed in claim 1, further comprising a sealing element disposed at the rear chamber of the outer cover and embedding the rear finger.

5. The electrical connector as claimed in claim 1, wherein the inner shell having a top wall, a bottom wall, and a pair of side walls, and each of the two side walls of the inner shell has a finger engaging the rear portion of the base.

6. An electrical connector comprising:

a metallic tubular inner shell being embedded, circumferentially and along a front-to-back direction, within an insulative outer cover via an insert-molding process except an inner face thereof and at least one piece formed at a rear edge thereof; and a terminal module including a plurality of contacts integrally formed within an insulative housing via another insert-molding process, the housing including a rear base and a front tongue extending forwardly from the base; wherein the outer cover forms a mating cavity in front of the base for receiving a mating connector, and a rear chamber which is located behind the mating cavity in said front-to-back direction and through which the terminal module is forwardly inserted into the outer cover and the associated inner shell so as to have the base intimately confront the inner shell outwardly; wherein said piece is originally located away from the rear chamber to allow the terminal module to be forwardly inserted into the outer cover while successively extending into the rear chamber to forwardly abut against the base for preventing rearward movement of the housing of the terminal module after the terminal module is completely assembled within the outer cover.

7. The electrical connector as claimed in claim 6, wherein the outer cover forms a recess adjacent to the piece so a tool is able to be inserted into the recess to deflect the piece so as to have the piece forwardly abut against the base after the terminal module is completely assembled within the outer cover.

8. The electrical connector as claimed in claim 7, wherein a waterproofing sealing element is received within the rear chamber to cover the piece after the piece is deflected to forwardly abut against the base.

9. The electrical connector as claimed in claim 8, wherein the housing further includes a rear extension holding tail portions of the contacts and located behind the sealing element in said front-to-back direction.

10. The electrical connector as claimed in claim 6, wherein the front tongue includes a thickened step section around a rear end thereof, and a front edge of the inner shell slightly projects beyond the base while not exceeding a front edge of said thickened step section of the front tongue.

11. The electrical connector as claimed in claim 10, wherein the inner shell further includes a stop at said front edge, and said stop not only extends into the mating cavity for preventing excessive insertion of the mating connector but also preventing forward movement of the base.

12. The electrical connector as claimed in claim 6, wherein a width of the inner shell along the front-to-back direction is slightly larger than a thickness of the base along said front-to-back direction.

13. An electrical connector comprising:

a metallic inner shell being at least partially embedded retainably, via an insert-molding process, within an insulative outer cover and having at least one rear piece exposed outside of the outer cover; and a terminal module including a plurality of contacts integrally formed within an insulative housing via another insert-molding process, the housing including a rear base and a front tongue extending forwardly from the base; wherein the outer cover forms a mating cavity in front of the base for receiving a mating connector, and a rear chamber which is located behind the mating cavity in said front-to-back direction and through which the terminal module is forwardly inserted into the outer cover and the associated inner shell; wherein at least one of the outer cover and the inner shell forms a stop in front of the rear piece in the front-to-back direction to prohibit further forward movement of the housing, and said rear piece is originally located away from the rear chamber to allow the terminal module to be forwardly inserted into the outer cover while successively extending into the rear chamber to forwardly abut against the base for preventing rearward movement of the housing of the terminal module after the terminal module is completely assembled within the outer cover and stopped by said stop.

14. The electrical connector as claimed in claim 13, wherein said rear piece originally is located away from the rear chamber in a relaxed manner while being forcibly deformed to extend into the rear chamber to prevent rearward movement of the housing.

15. The electrical connector as claimed in claim 13, wherein said stop is formed on the inner shell.

16. The electrical connector as claimed in claim 13, wherein the outer cover forms a recess around the rear piece so as to allow a tool to enter for operating the piece.

17. The electrical connector as claimed in claim 16, further including a waterproof sealing element attached behind the base in the rear chamber to cover the rear piece and occupying the recess.

18. The electrical connector as claimed in claim 17, wherein the housing forms a recess receiving the rear piece therein and occupied by the sealing element.

19. An electrical connector comprising:

a metallic inner shell being retained and embedded, via an insert-molding process, within an insulative outer cover, and having, along a front-to-back direction, a front stop and a rear finger which are exposed outside of the outer cover;

a mating cavity formed in the outer cover and located in front of the front stop for receiving a mating connector; and a terminal module being discrete from the outer cover and including a plurality of contacts integrally formed within an insulative housing via another insert-molding process, the housing including a rear base and a front tongue extending forwardly from the base; wherein the front stop is located in front of the base to rearwardly abut against the base for preventing forward movement of the base, and the rear piece forwardly abuts against the base for preventing rearward movement of the base so as to have the terminal module retained in the outer cover along the front-to-back direction.

20. The electrical connector as claimed in claim 19, wherein the outer cover is configured to allow the terminal module to be forwardly assembled therein along the front-to-back direction when the rear finger is located in an initial position without blocking, and the rear finger is moved from the initial position to a final position for forwardly abutting against the base after the terminal module is completely assembled into the outer cover to prevent rearward withdrawal of the terminal module from the outer cover.

* * * * *